US006698787B1

(12) United States Patent
Gignoux et al.

(10) Patent No.: US 6,698,787 B1
(45) Date of Patent: Mar. 2, 2004

(54) STEP-IN SNOWBOARD BINDING

(75) Inventors: Pierre Gignoux, Coublevie (FR); Alain Plassiard, S'Egrève (FR)

(73) Assignee: Emery S.A., Saint Egreve (FR)

( * ) Notice: Subject to any disclaimer, the term of this patent is extended or adjusted under 35 U.S.C. 154(b) by 28 days.

(21) Appl. No.: 09/718,045

(22) Filed: Nov. 21, 2000

(30) Foreign Application Priority Data

Nov. 23, 1999 (FR) ..... 99 14696

(51) Int. Cl.[7] ..... A63C 9/10; A63C 9/16; A63C 9/18; A63C 9/20; A63C 9/22; A63C 9/24

(52) U.S. Cl. ..... 280/624; 280/626; 280/636

(58) Field of Search ..... 280/607, 617, 280/618, 624, 625, 623, 626, 633, 634, 636, 14.21, 14.22, 14.23

(56) References Cited

U.S. PATENT DOCUMENTS

| | | | | |
|---|---|---|---|---|
| 4,097,062 A | | 6/1978 | Salomon | |
| 4,973,073 A | | 11/1990 | Raines | |
| 5,690,351 A | | 11/1997 | Karol | |
| 5,722,680 A | * | 3/1998 | Dodge | 280/14.22 |
| 5,871,226 A | | 2/1999 | Klubitschko et al. | |
| 5,957,479 A | * | 9/1999 | Bayer et al. | 280/14.21 |
| 6,053,524 A | | 4/2000 | Laughlin | |
| 6,109,643 A | * | 8/2000 | Bayer et al. | 280/14.22 |
| 6,113,127 A | * | 9/2000 | Karol | 280/618 |
| 6,123,354 A | * | 9/2000 | Laughlin et al. | 280/607 |
| 6,203,052 B1 | * | 3/2001 | Dodge | 280/14.22 |
| 6,279,924 B1 | * | 8/2001 | Murphy et al. | 280/14.22 |
| 6,290,250 B1 | * | 9/2001 | Karol | 280/14.24 |

FOREIGN PATENT DOCUMENTS

| | | |
|---|---|---|
| FR | 2 742 997 A | 7/1997 |
| FR | 2 745 192 A | 8/1997 |
| FR | 2 758 091 A | 7/1998 |
| WO | WO 96/26774 | 2/1996 |

OTHER PUBLICATIONS

Preliminary Search Report IN SN FR 9914696.

* cited by examiner

*Primary Examiner*—Brian L. Johnson
*Assistant Examiner*—Bridget Avery
(74) *Attorney, Agent, or Firm*—Bugnion S.A.; John Moetteli

(57) ABSTRACT

Step-in snowboard binding designed to hold a boot by its sides. The binding comprises at least one jaw (2) secured to a driving arm (9) intended to be driven by the boot. The jaw has a cam-shaped part (9) collaborating with a locking element (12) which can move in a guide (13) in such a way that the jaw is locked for various positions of the jaw. The jaw (2) is equipped with a return spring which tends to keep it in the open position, and the jaw and the locking element cooperate to keep the locking element away from its locking position when the jaw is raised. In this way, the jaw cannot be closed inadvertently and the locking element does not hamper the closure movement.

23 Claims, 19 Drawing Sheets

STEP-IN SNOWBOARD BINDING

BACKGROUND OF THE INVENTION

The present invention relates to a step-in snowboard binding in particular; a step-in snowboard binding designed to hold a boot by its sides.

A binding such as this is disclosed in U.S. Pat. No. 5,871,226, the content of which is incorporated by reference. This binding allows the boot to be held firmly when there is snow or ice present on the baseplate and when this snow or this ice melts and the boot tends to drop, the difference in height of the boot is automatically taken up by the binding. Furthermore, the locking element provides a firm grip, without elastic play, and without the jaw having to be acted upon by a powerful spring in order to achieve this. What happens is that the jaw is held pressed against the boot by the locking element, it being possible for this locking to be provided by appropriate shapes, without there being the need to have a powerful spring acting on the locking element. A binding such as this avoids the drawbacks of the bindings of the prior art, such as the bindings described in U.S. Pat. No. 4,973,073, the content of which is incorporated by reference, and U.S. Pat. No. 4,097,062, the content of which is incorporated by reference.

Other sources disclose bindings with two lateral jaws. A binding such as this is disclosed in document U.S. Pat. No. 6,053,524, the content of which is incorporated by reference, for a monoski. Another binding is disclosed in document WO 96/26 774, the content of which is incorporated by reference.

In the binding according to U.S. Pat. No. 5,871,226, the content of which is incorporated by reference, the jaw is urged by a return spring and the wedge-shaped locking element is also used as a means for holding the jaw in the open position, the jaw pressing against the end of the locking element. This locking element is therefore constantly pressed against the cam of the jaw and, when the boot is being put into the binding, the jaw has first of all to push back the locking element. In the open position, as the cam presses via a rounded portion against an (also rounded) portion of the end of the locking element, wear of the contracting surfaces is likely to cause the jaw to become locked in the open position.

Therefore, what is needed is a step-in binding which overcomes these drawbacks.

SUMMARY OF THE INVENTION

The step-in binding is provided in which the jaw is equipped with a return spring tending to keep its jaw in its open position, and the jaw and the locking element comprise collaborating means for keeping the locking element away from its locking position when the jaw is raised and as long as the jaw has not at least approximately reached a position likely to be a position for retaining the boot. The jaw is therefore not held in the open position by the locking element, but by its return spring. It therefore does not carry any risk of being closed inadvertently. Furthermore, in its first phase of closure, before it has at least approximately reached a position likely to be a boot-retaining position, the locking element does not in any way impede the jaw-closing movement.

The object of the invention is to produce a step-in snowboard binding, in which the jaw, or jaws, are not impeded in their open position by the locking element and do not carry the risk of being closed inadvertently when no boot is present.

According to a first embodiment of the invention, the locking element is in the form of a peg and the guide for this peg is directed at least approximately vertically.

According to one embodiment, the peg can rotate and is fitted with at least one radial arm which rotates as one with the peg, resting, via its end, on a stop when the jaw is in the raised position, the jaw being secured to an auxiliary cam retaining the radial arm in this pressing position, the shape of the cam-shaped part being such that it releases the radial arm when the jaw is lowered, allowing the locking peg to move into the locking position.

The jaw is preferably mounted in a mount forming a roughly vertical guide for a set of moving parts carrying said peg and the jaw comprises a means for deliberately raising this set of moving parts, actuation of which allows the jaw to be raised and the radial arm of the peg to be returned to a position resting against the mount.

The binding is preferably equipped with two opposed jaws which are kinematically connected so that the two jaws can be lowered simultaneously so that one jaw cannot close without the other jaw closing also. Mechanical play is advantageously provided in the kinematic link between the jaws so as to take account of a slightly oblique position of the boot as the result of snow or ice being present under the boot.

According to another embodiment, the cam-shaped part of the jaw has a lateral wall forming a stop for the locking element so as to keep it away from its locking position and a cutout forming a circumferential stop, and the locking element consists of a finger which can move at least approximately parallel to the axis of rotation of the jaw and is in the shape of a wedge pressing against the circumferential stop as it enters said cutout after the jaw has rotated a certain amount. Like in the first embodiment, the opposite retaining element advantageously consists of a second jaw identical to the first and the two locking fingers are kinematically linked. In this case too, mechanical play is advantageously built into this kinematic link.

BRIEF DESCRIPTION OF THE DRAWINGS

The appended drawing depicts, by way of example, two embodiments of the binding according to the invention.

DESCRIPTION OF THE PREFERRED EMBODIMENT(S)

Figure 1:
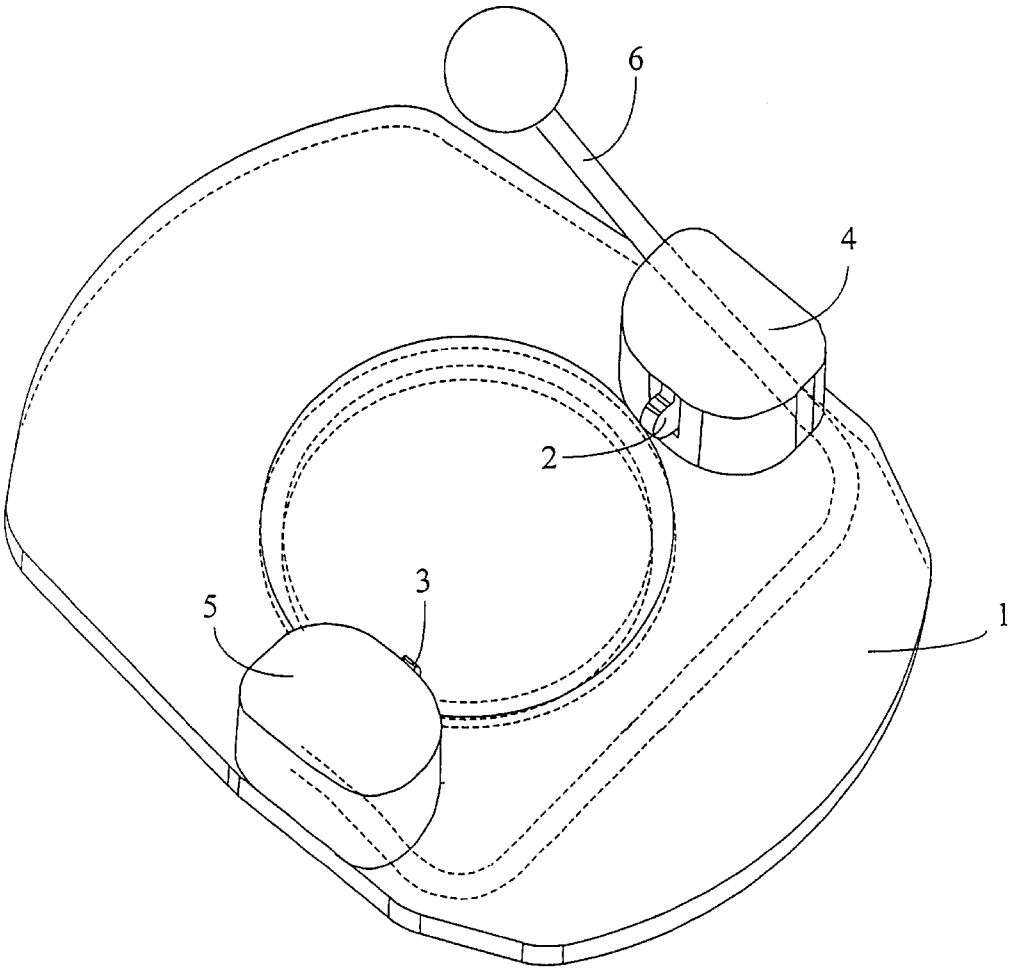
FIG. 1 is a perspective view of the first embodiment.

In the form seen by the user, the binding depicted in FIG. 1 comprises a baseplate 1 intended to be fixed to the snowboard, two opposed jaws 2 and 3 mounted on the baseplate 1 and covered with a cap 4, 5, respectively. The binding further comprises a release lever 6, actuation of which releases the jaws which then return to their open position as depicted in FIG. 1. As the jaws are identical, this text will merely describe the jaw 2 with reference to FIGS. 2 and 3.

The jaw 2 is in the form of a profiled flat part mounted in a mount 7 consisting of a piece of metal pressed and folded to form a tubular part with two lugs 7*a* and 7*b* by which the mount is fixed to the baseplate 1. Jaw 2 is mounted so that it can rotate in the mount 7 by means of a horizontal axle 8 and is equipped with a return spring 58 which tends to return the jaw to its open position. The jaw 2 has a driving arm or pedal 9. Fixed to one of the sides of the jaw 2 is a cam 10 approximately in the shape of a sector of an eccentric circle extending over 90°. This cam may of course be formed integrally with the jaw 2.

Figure 2:
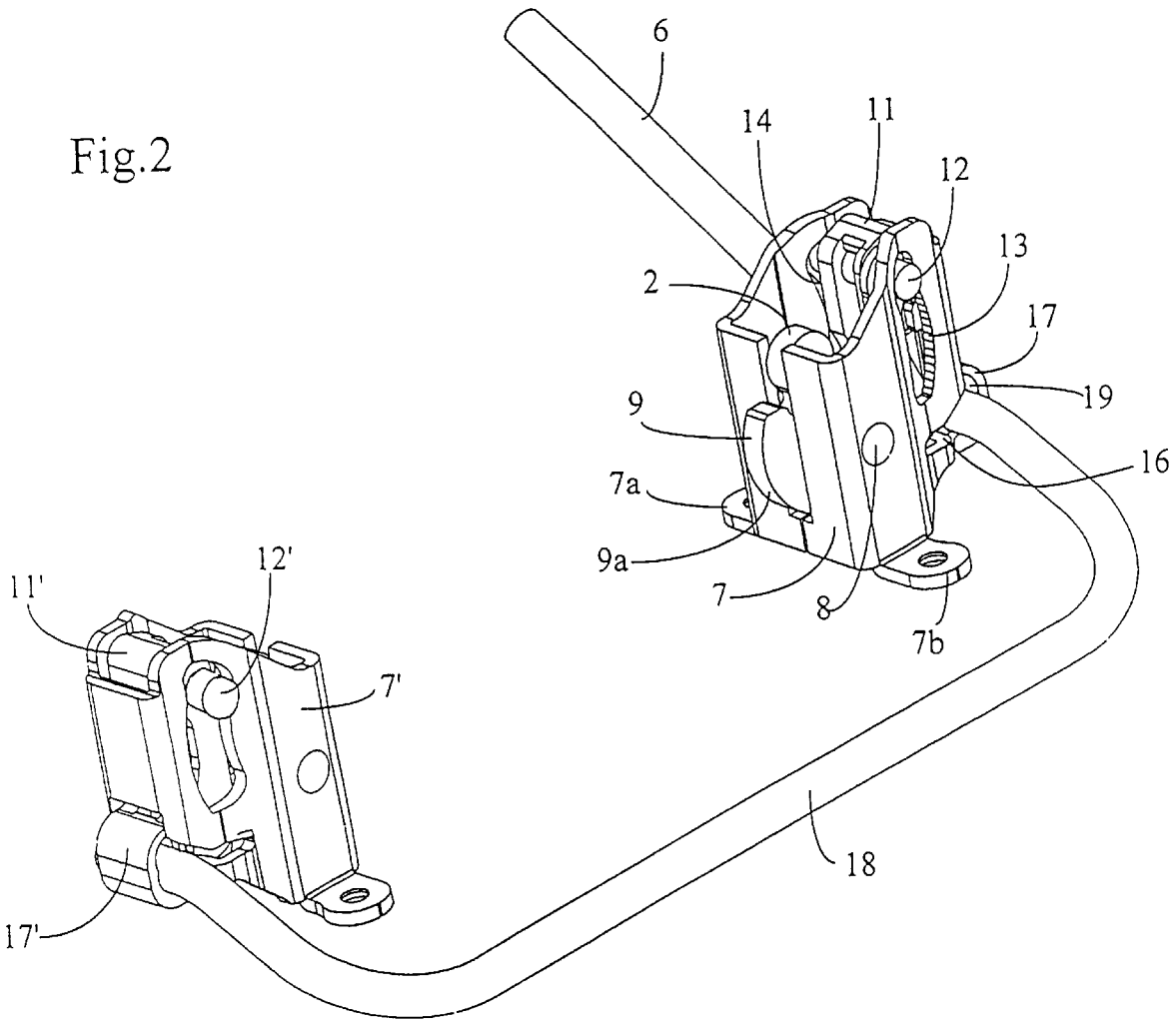
FIG. 2 is a perspective view of it similar to that of FIG. 1, without the baseplate and the caps which cover the jaw mounts.
Figure 3:
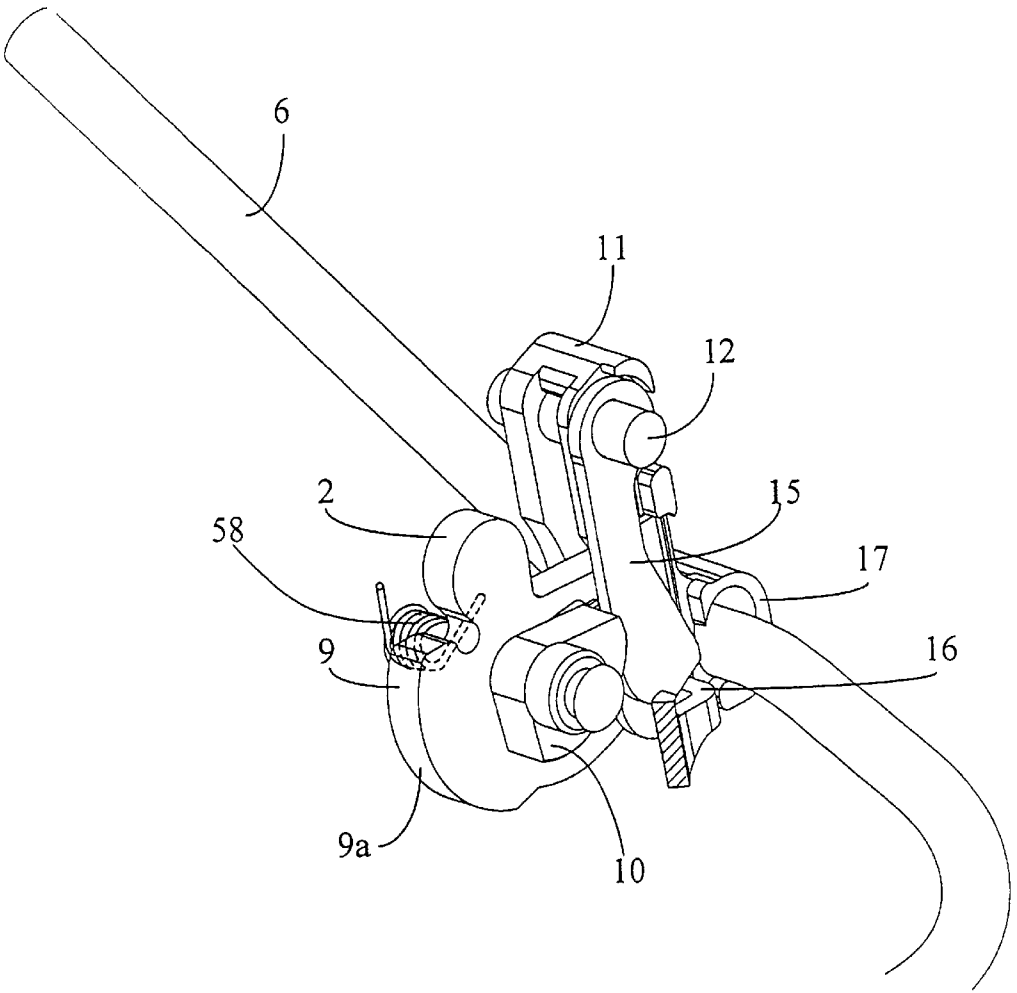
FIG. 3 depicts one of the jaws in the open position and the locking means inside the jaw mount.
Figure 4:
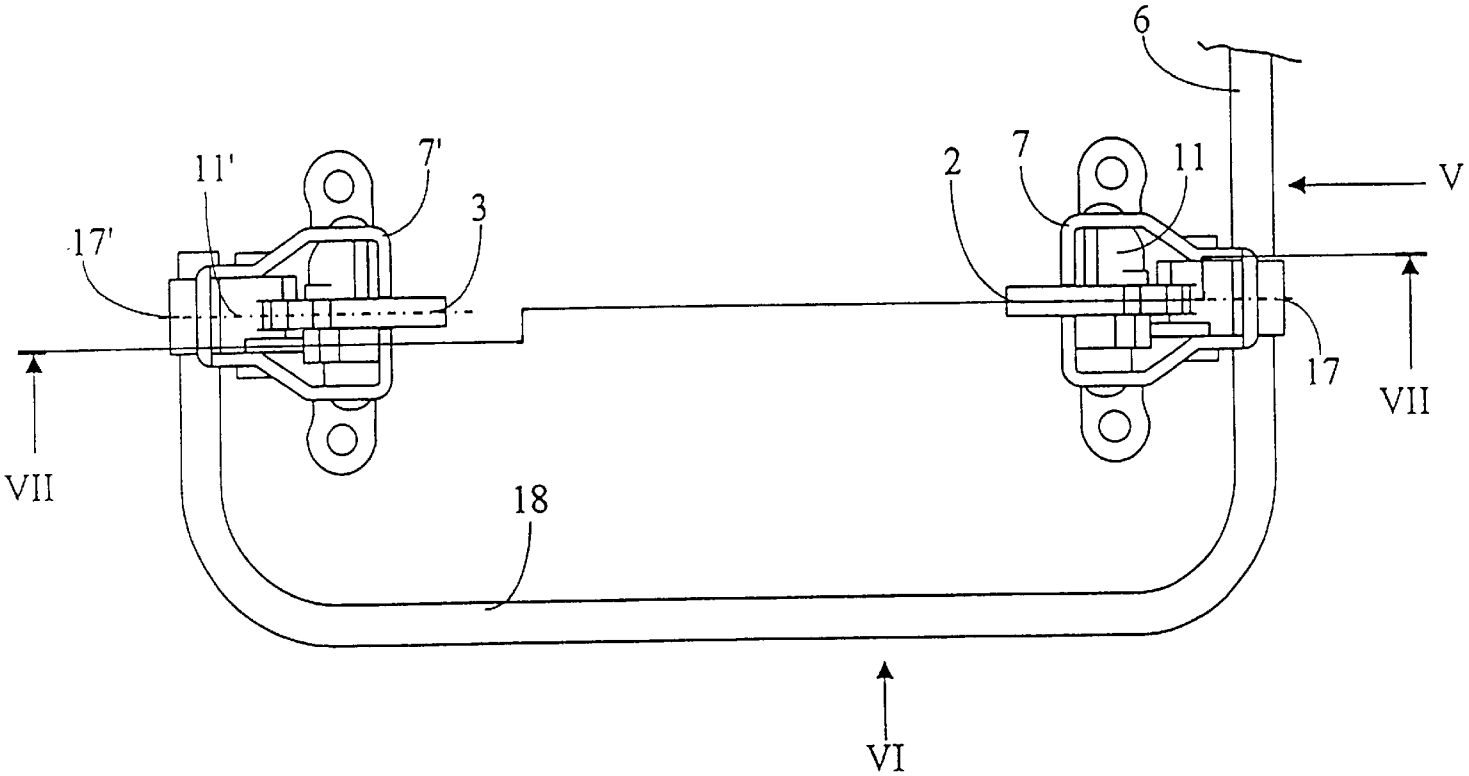
FIG. 4 is a plan view from above of the binding without the baseplate.

The mount 7 also constitutes a guide for a set of moving parts 11 which, in their upper part, carry a peg 12, the axis of which is parallel to the axis of rotation of the jaw and which constitutes the jaw-locking element. This peg 12 is itself engaged, via its ends, in two opposed grooves or slots 13 and 14 made in two opposed walls of the mount 7. The peg 12 is equipped with a radial arm 15 which rotates as one with the peg 12. The actuating arm 9 is extended circumferentially by a cam-shaped part 9*a* intended to collaborate with the peg 12 to lock the jaw, as will be described later on. When the jaws are in the open position as depicted in FIGS. 2 and 3, the arm 15 presses, via its end, on a bearing surface 16 of the mount 7 and is kept in this position by the cam 10. The set of moving parts 11, in its lower part, has a portion 17 curved around the release lever 6 and this provides a mechanical link between the set of moving parts 11 and the lever 6.

Figure 5:
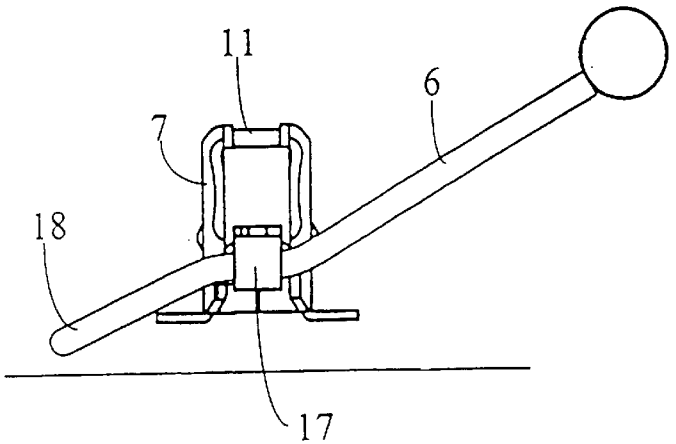
FIG. 5 is a side view in the direction of arrow V, FIG. 4.

In its position of rest the lever 6 is oblique but has a short section which is horizontal passing through the part 17 of the set of moving parts as can be seen in FIG. 5. Beyond the part 17, the lever 6 is extended by a transverse part 18 extending under the baseplate 1 to rise back up on the other side of the opposite jaw 3 where its end is engaged horizontally in the part 17' of the set of moving parts 11' of the opposite jaw. The two sets of moving parts are thus mechanically and kinematically linked. Locking is therefore achieved simultaneously by both jaws by the simultaneous downward movement of the locking pegs 12 and 12'. The link between the part 17 of the set of moving parts and the lever 6 does, however, exhibit play 19, which is also present in the corresponding part 17' of the other jaw. This play, in the locked on-boot position, makes it possible to take account of a slightly oblique position of the sole of the boot relative to the baseplate, which position might be due to snow or ice being present on just one side or present on both sides but in unequal amounts.

Mounted around the part 18 of the release lever is a torsion spring which tends to lower the release lever 6, that is to say to drive the sets of moving parts 11 and 11' downward. The way in which the binding works will now be described with reference to FIGS. 6 to 15. In general, elements of the opposite jaw 3 are denoted by the same references, accompanied by the symbol '.

Figure 6:
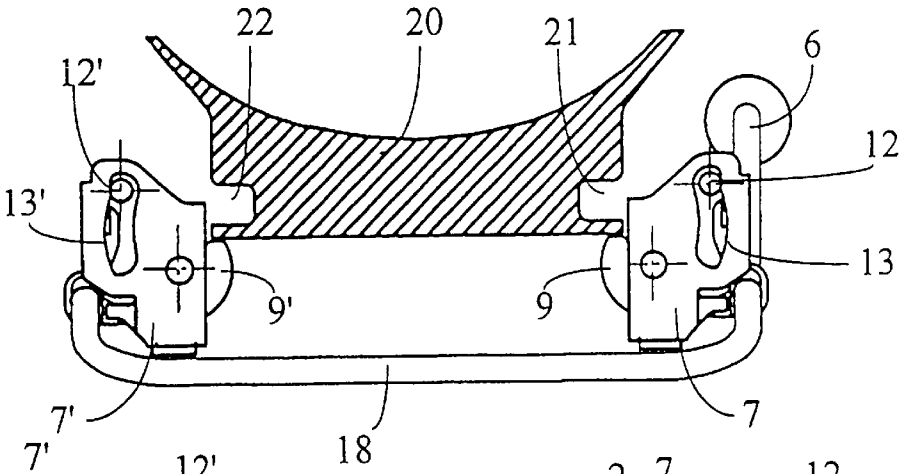
FIG. 6 is a view of the elements depicted in FIG. 4 in direction VI, at the start of introduction of the boot.
Figure 7:
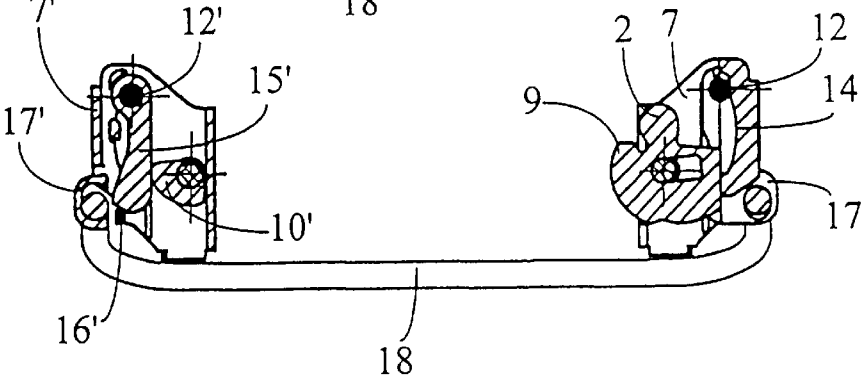
FIG. 7 is a view in section on VII—VII of FIG. 4.

FIGS. 5 to 7 depict the jaws still in the open position, that is to say the same position as the one depicted in FIGS. 2 and 3. FIG. 7 in particular shows that the arm 15' of the jaw 3 is in abutment against its stop 16' so that the pegs 12 and 12' are held at the top end of their guide.

The boot 20, laterally equipped with two housings 21, 22, presses on the actuating arms 9 and 9'. It can be seen (FIG. 7) that in this position the pegs 12 and 12' are still kept in their high position, their arm 15 to 15' pressing against the stops 16 and 16'.

Figure 8:
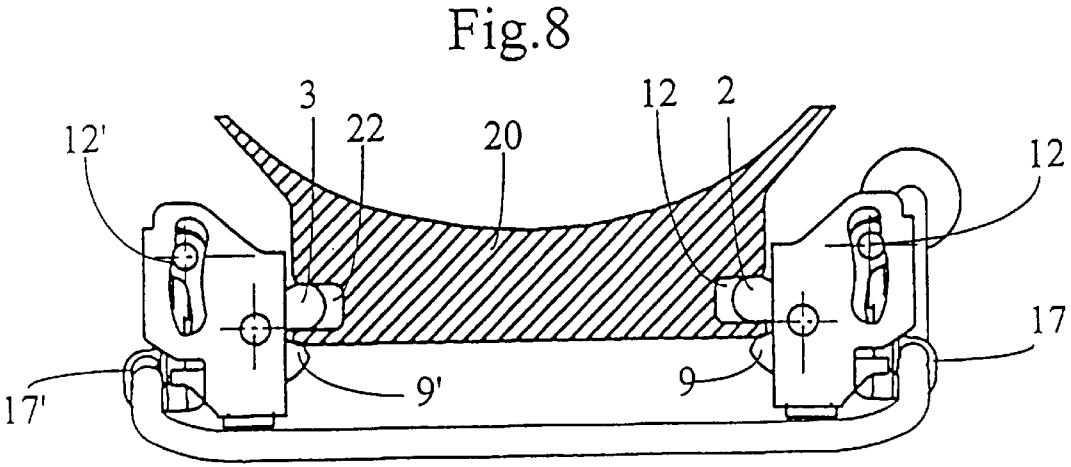
FIGS. 8 and 9 are views similar to FIGS. 6 and 7, the binding being depicted in the position on the highest-lying boot with a wedge of snow under the boot.
Figure 9:
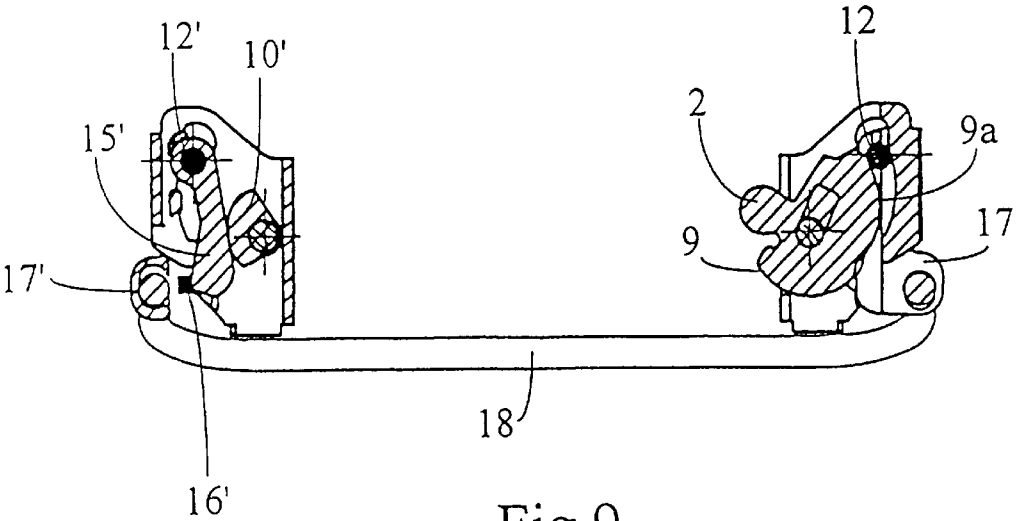
Figure 10:
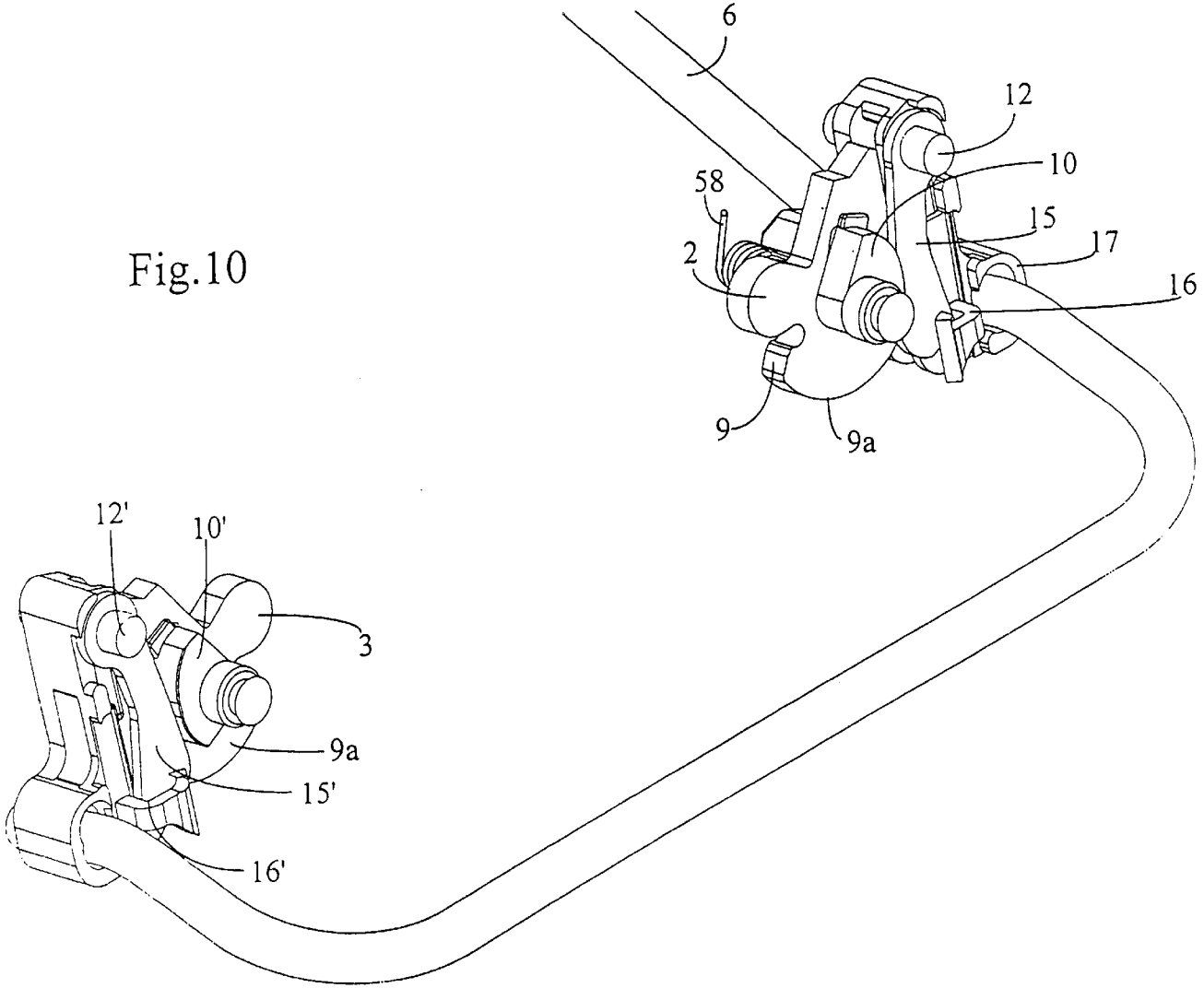
FIG. 10 is a perspective view of the jaws and of the locking elements in the position depicted in FIGS. 8 and 9.

When the boot 20 exerts pressure on the driving arms 9 and 9', this pressure causes the jaws to rotate (FIGS. 8 and 9). The rotation of the cams 10 and 10' has the effect of allowing the arms 15 and 15' to leave their stop, as can be seen in the case of the arm 15' in FIG. 9. The pegs 12 and 12' can thus drop, guided in the slots in the mount 7. It is first of all assumed that the downward movement of the boot is limited by snow under the baseplate of the binding or under the sole of the boot, this position being depicted in FIG. 8. The boot can therefore not move down any further, but cannot move up either because the pegs 12 and 12' have engaged and jammed between the cams 9*a*, 9*a'* and the outer sides of the guide slots 13, 14, 13', 14'. The boot is thus perfectly held in this position.

If the snow compacts or melts and the boot tends to move downward, the shape of cams 9*a*, 9*a'* and the shape of the slots that guide the pegs 12 and 12' is such that the pegs continue to drop downward, until they again jam between the cams and the guide slots.

Figure 11:
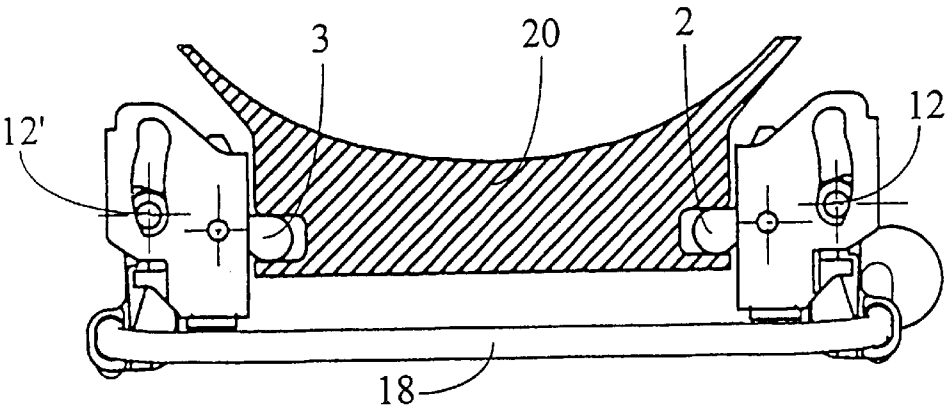
FIGS. 11 and 12 are views similar to FIGS. 6 and 7 in a position on the boot in which the boot sits at its lowest level, when there is no snow or ice on the baseplate or under the boot.
Figure 12:
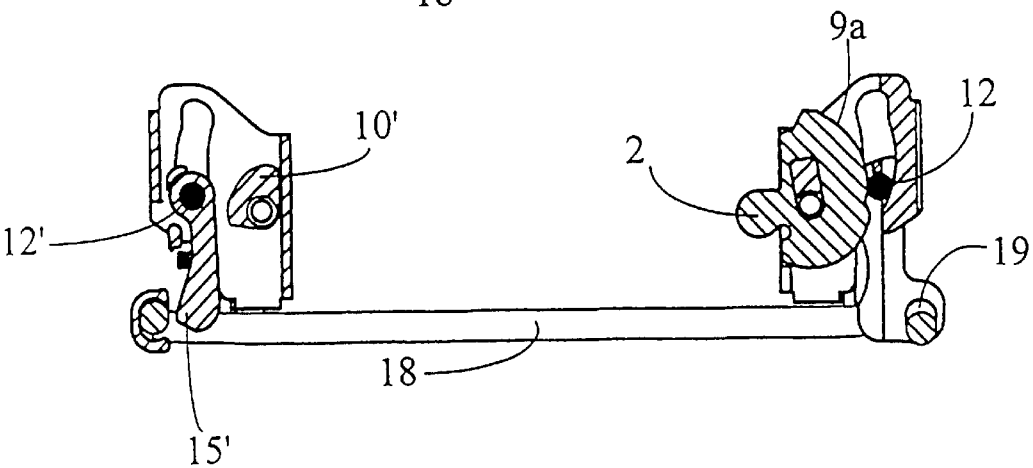
Figure 13:
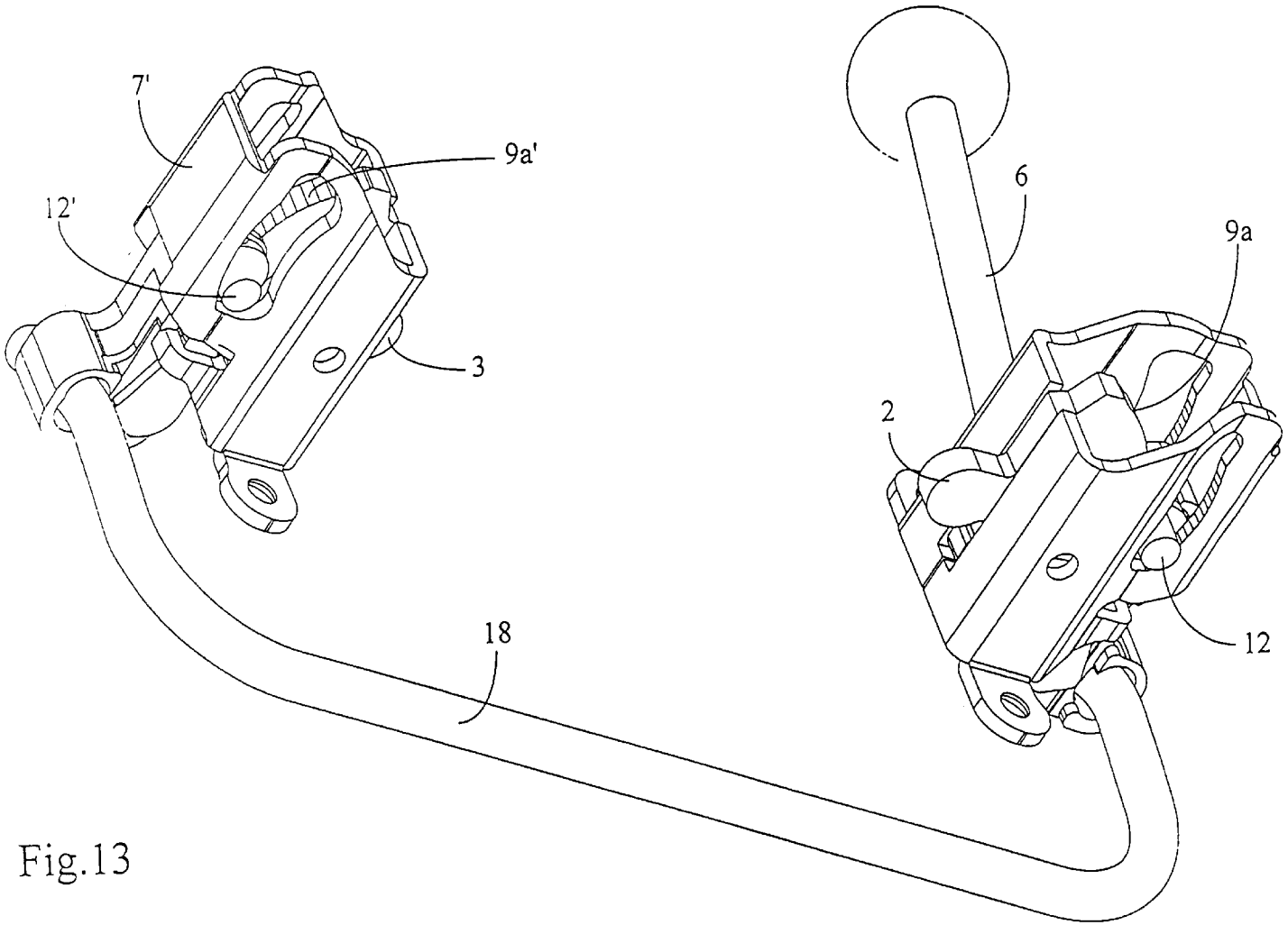
FIG. 13 is a perspective view in a position similar to the position depicted in FIGS. 11 and 12.
Figure 14:
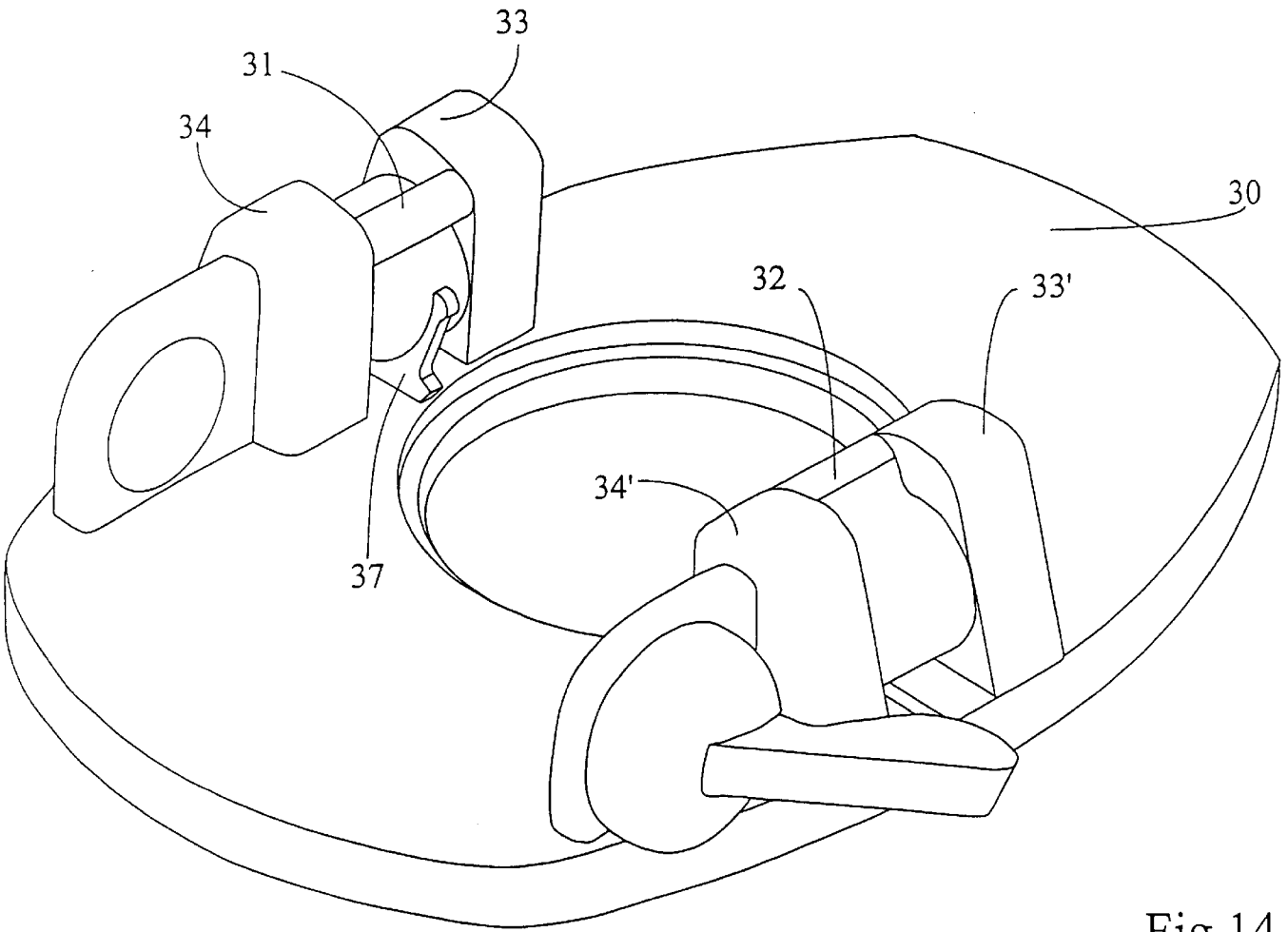
FIG. 14 is a perspective view of the second embodiment, with no boot.
Figure 15:
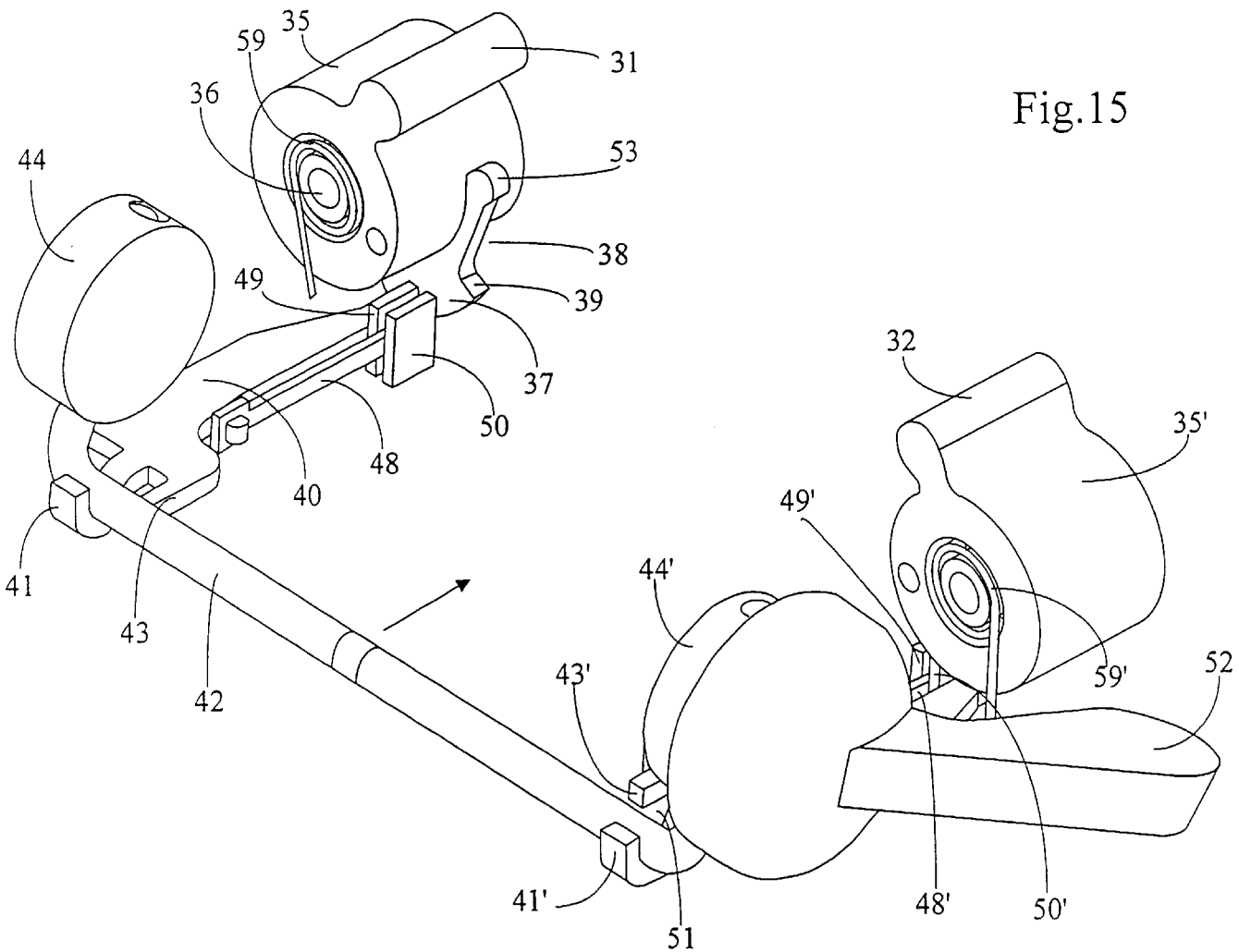
FIG. 15 is a view similar to that of FIG. 14, without the baseplate or the bearings of the jaws, or those of the locking-element drive devices.
Figure 16:
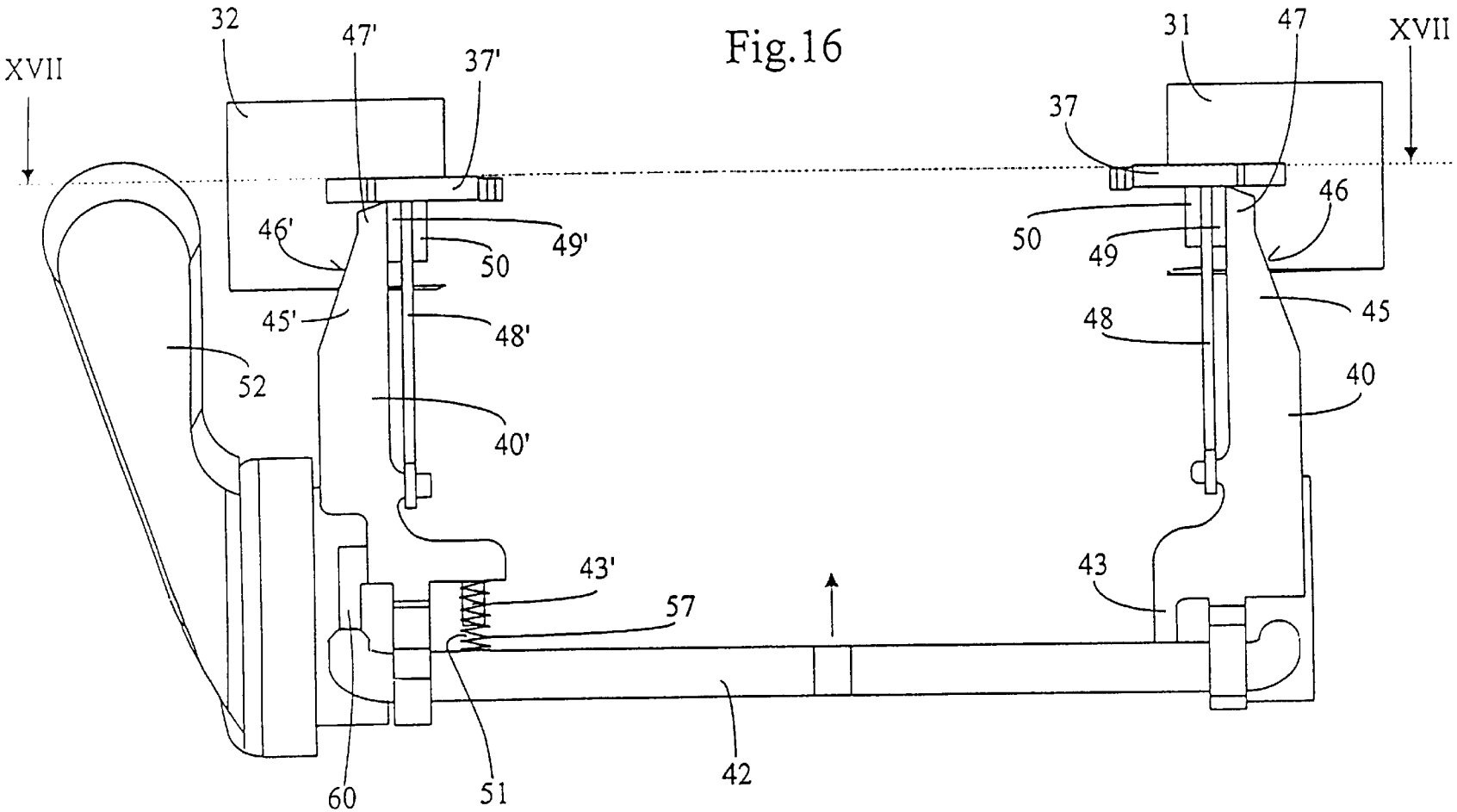
FIG. 16 is a plan view from underneath of the parts depicted in FIG. 15.
Figure 17:
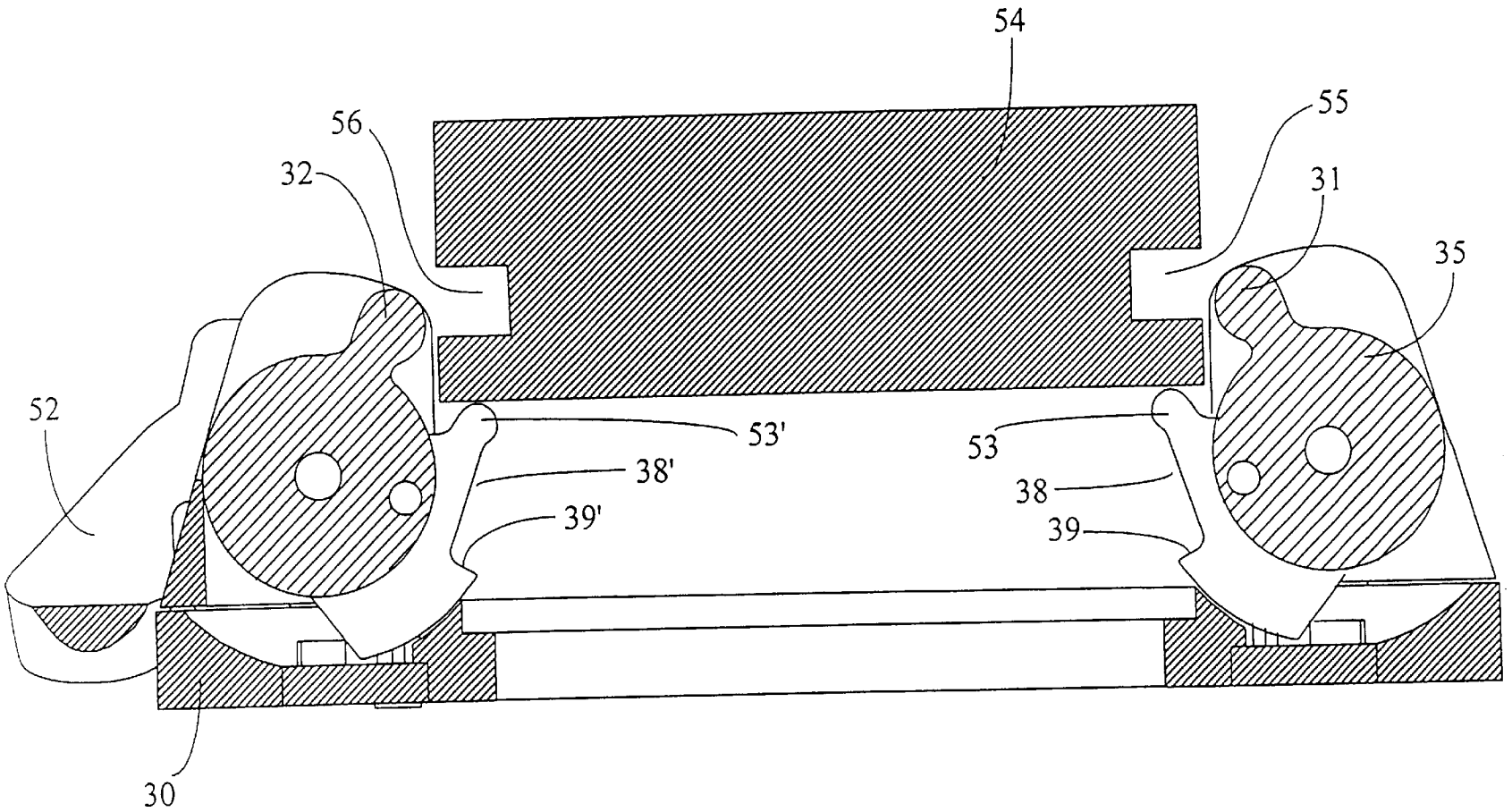
FIG. 17 is a view in section on XVII—XVII of FIG. 16, in which the boot, depicted diagrammatically, is just in contact with the jaw-driving arms.

The lowest position is depicted in FIGS. 11 and 12. In this position, the locking pegs 12 and 12' have practically reached the bottom ends of the guide slots. It can also be seen that the release lever 6 has gradually lowered as the boot has dropped down to finally occupy a very slightly oblique position.

If one of the jaws drops down less than the other because there is snow on one side of the boot or the thickness of snow differs between the two sides of the boot, one of the pegs 12 or 12' will not drop down as much as the other peg. This is what can be seen in FIG. 12. This difference in height is allowed by the aforementioned play 19 which can be seen in FIG. 12. This play can of course be spread across the two sets of moving parts 11 and 11'.

To release the boot from the binding all that is required is for the release lever to be pulled upward, which has the effect of driving the sets of moving parts 11 and 11' and with them the locking pegs 12 and 12' upward. The jaws, released, rise up under the effect of their return spring and the retaining arms 15 and 15' for the sets of moving parts return, under the effect of their return spring, into abutment against the mount.

The second embodiment will now be described with reference to FIGS. 14 to 21.

As can be seen in FIG. 14, this embodiment again includes a baseplate 30 carrying two opposed jaws 31 and 32 and mounted so that it can pivot in a pair of bearings 33, 34 and 33', 34', respectively. The jaws 31 and 32 are identical and therefore only the jaw 31 will be described, with the aid of FIGS. 15 and 16.

The body of the jaw 31 is in the form of a cylinder 35 equipped with a hub 36 for the passage of the jaw pivot axle. The cylinder 35 has a cam-shaped part consisting of a radial wall 37 projecting radially from the circumference of the cylinder 35. This wall 37 has a cutout 38, the lower side 39 of which extends practically radially relative to the axis of the body 35 and thus forms a circumferential stop. Mounted around the hub 36 is a return spring 59, one end of which is attached to the hub 36 in a known way. The spring 58 tends to keep the jaw in its open position depicted in FIGS. 14 and 15. The upper end 53, 53', respectively, of the radial wall 37, 37' constitutes an arm for driving the jaw.

The jaw locking element consists of a finger 40 in the form of a cut plate arranged parallel to the baseplate 30 and equipped with a posterior end in the form of a hook 41 by means of which the finger 40 is secured to a drive bar 42. More specifically, the bar 42 rests on one side against the hook 41 and on the other side against an arm 43 of the finger 40.

The finger 40' is equipped with a second arm 60 collaborating with the upwardly bent part of the drive bar 42, as will be described later.

The bar 42 has two ends bent at right angles and engaged respectively in a drum 44, 44'. These drums are urged to rotate by springs (not depicted) which tend to push the bar 42 toward the jaws, that is to say in the direction of the arrow in FIG. 15.

The fingers 40 and 40' guided in the baseplate 1 and driven by the bar 42 abut, via their ends, against the radial wall 37, 37'. When the binding is open, the fingers 40 and 40' are thus kept out of the cutouts 38 and 38'. The fingers 40, 40', have a part 45, 45', which narrows along its length thus forming a ramp 46, 46'. The end of the fingers 40, 40' however, has a part 47, 47' of constant width, the length of the part 47 exceeding that of the part 47' of the other finger. The end of the fingers 40, 40' resting against the wall 37, 37' is beveled.

Like in the first embodiment, the locking fingers 40 and 40' are therefore kinematically linked by the bar 42, so as to synchronize the locking of the two jaws, but in this case, one of the links (in this instance that of the finger 40') has play 51, the arm 43' being shorter than the arm 43. This play 51 is occupied by a spring 57 (FIG. 18) keeping the bar 42 against the hook 41'.

The binding is also equipped with a release lever 52 so that the drum 44', and with it the bar 42, can be rotated.

The way in which this second embodiment works will now be described with the aid of FIGS. 15 to 21.

Figure 18:
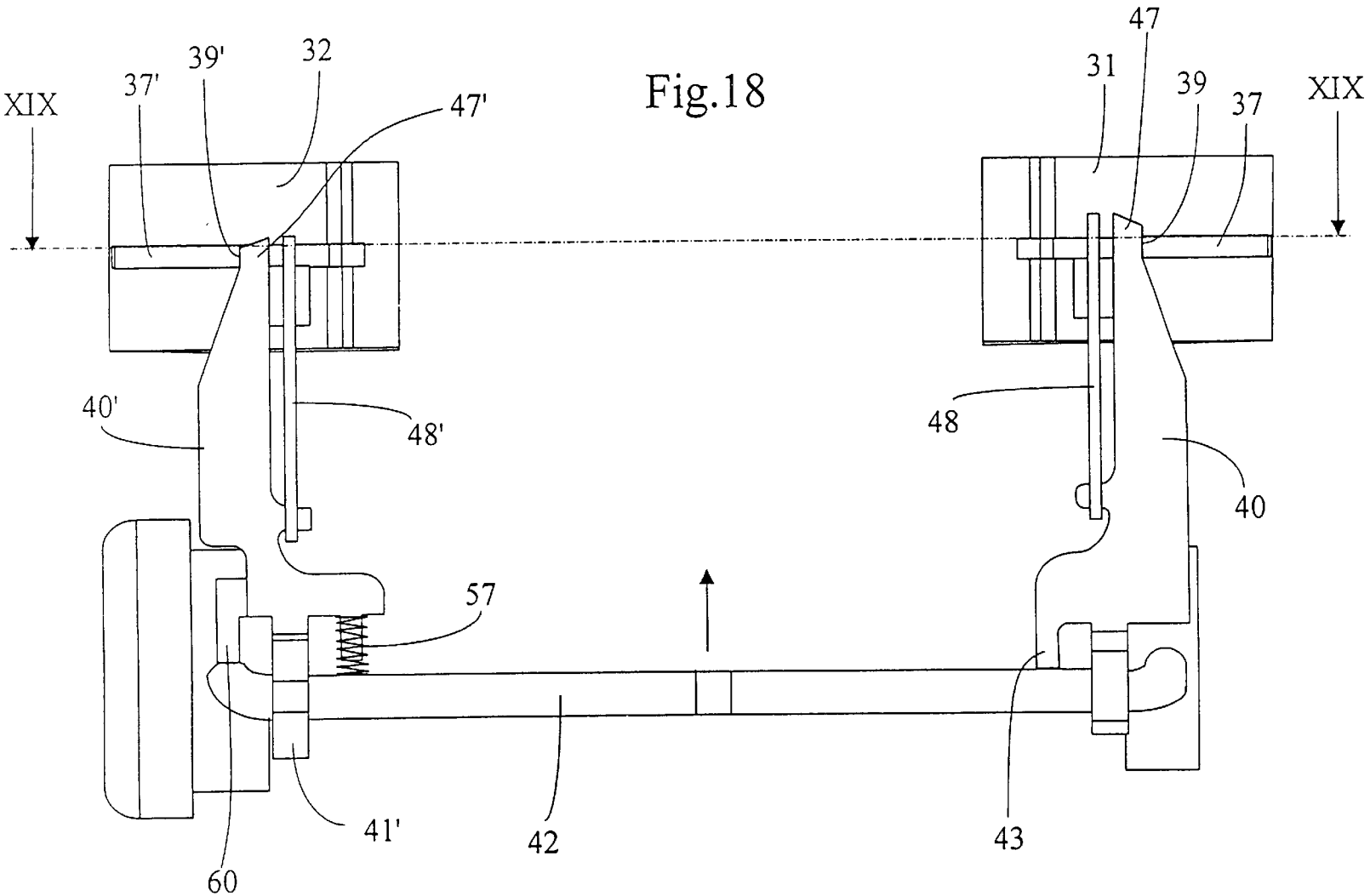
FIG. 18 is a view similar to FIG. 16, after the locking fingers have entered the cams.

With the binding in the open position, with the jaws up, when a boot 54 (FIG. 17) is introduced into the binding it comes into abutment against the driving arms 53, 53'. In this position, the finger 40 is kept, without play, against the cam 37 by the operating bar 42 and the finger 40' is kept, without play, against the cam 37' by the bar 42 pressing on the auxiliary arm 60. As it moves downward, the boot drives the arms 53, 53', and with them the jaws 31 and 32 in terms of rotation. After rotation through a certain angle, the fingers 40 and 40' find themselves facing the cutouts 38, 38' and can advance under the thrust of the bar 42, as depicted in FIG. 18. The beveled ends of the fingers 40 and 40' prevent the fingers from advancing abruptly and thus prevent the jaws from closing sharply. The fingers 40, 40' accompany the rotation of the cams 37, 37' rather than playing a part in driving these cams.

The fingers 40 and 40' enter the respective cutouts 38 and 38' either simultaneously or with a slight time lag between them as a result of an oblique position of the boot. The straight part 47 is longer than the corresponding part 47' because the movement of the finger 40 is associated with the movement of the bar 42, whereas the finger 40' is pushed by the spring 57 as soon as it has left the lateral face of the cam 37'. The straight parts 47 and 47' are a guarantee, by engaging in the cutouts 38 and 38', that the fingers 40 and 40' are properly engaged before the intervention of the ramps 46 and 46'. They therefore constitute a safety feature.

If the boot moves down, the position becomes laterally oblique, such that the jaw 31 moves down first, the finger 40 is pushed forward by the bar 42, but the bar 42 moves away from the auxiliary arm 60 of the arm 40' and the movement of the transverse part of the bar 42 is absorbed by the spring 57. The finger 40' then compensates the arm 40 under the thrust of the spring 57.

If the jaw 32 moves down first, the finger 40' moves forward, also under the thrust of the spring 57, whereas the bar 42, retained by the finger 40, remains immobile.

Figure 19:
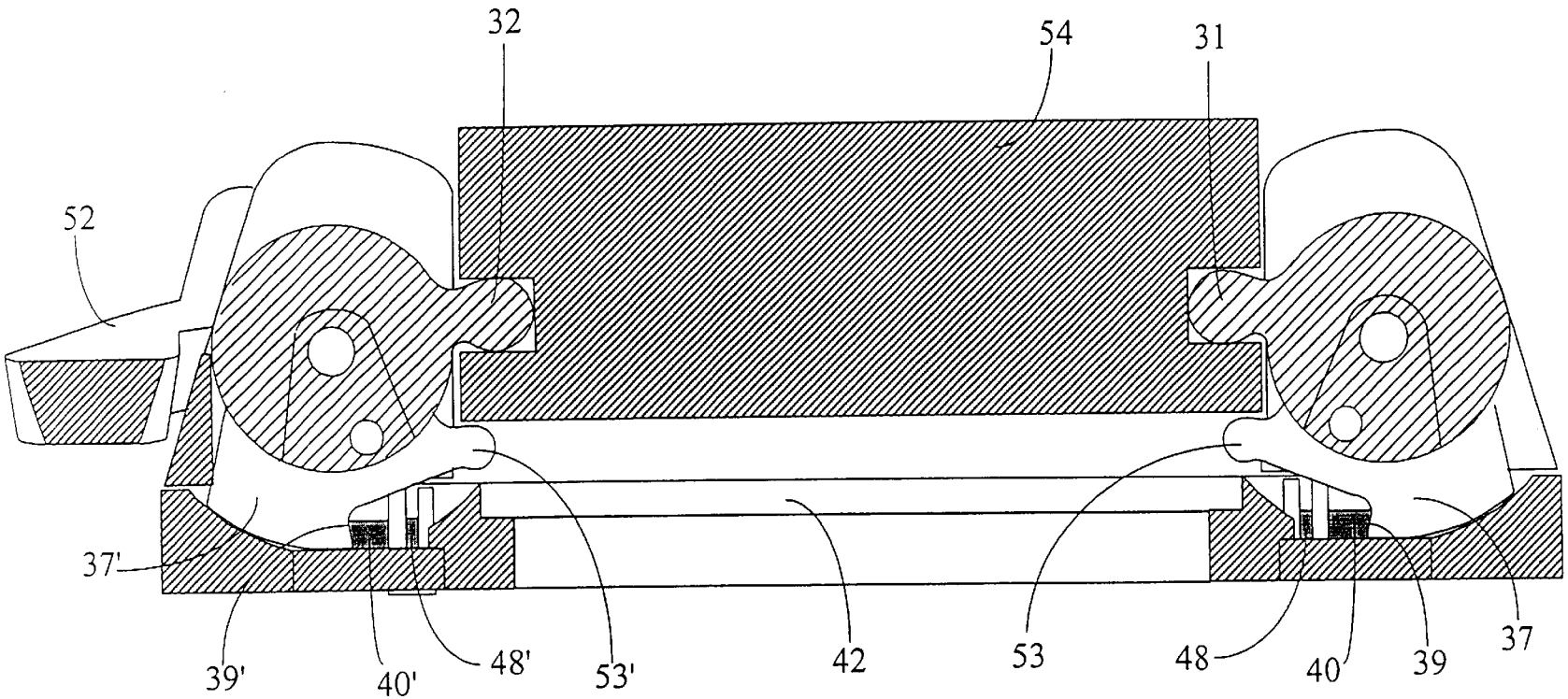
FIG. 19 is a view in section on XIX—XIX of FIG. 18, in which the boot is depicted locked in a high position.

The position depicted in FIGS. 18 and 19 is the uppermost position of the boot above the baseplate in which the jaws 31 and 32 can be locked. The cams 37 and 37' are at the bottom of the ramps 46 and 46'.

Figure 20:
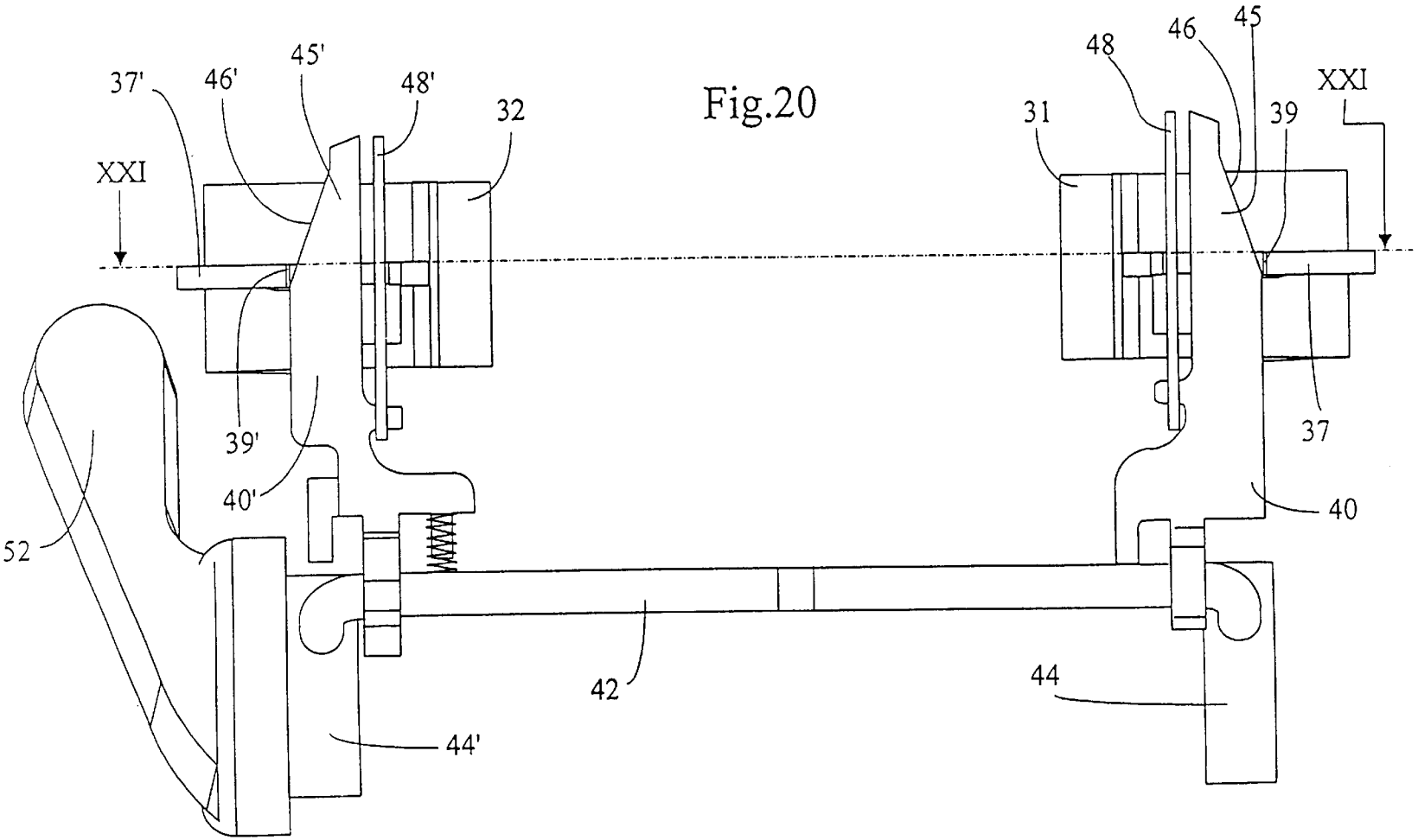
FIG. 20 is a plan view similar to FIGS. 16 and 18, after the locking fingers have fully engaged in the cams of the jaws and when the boot is in its lowest position.
Figure 21:
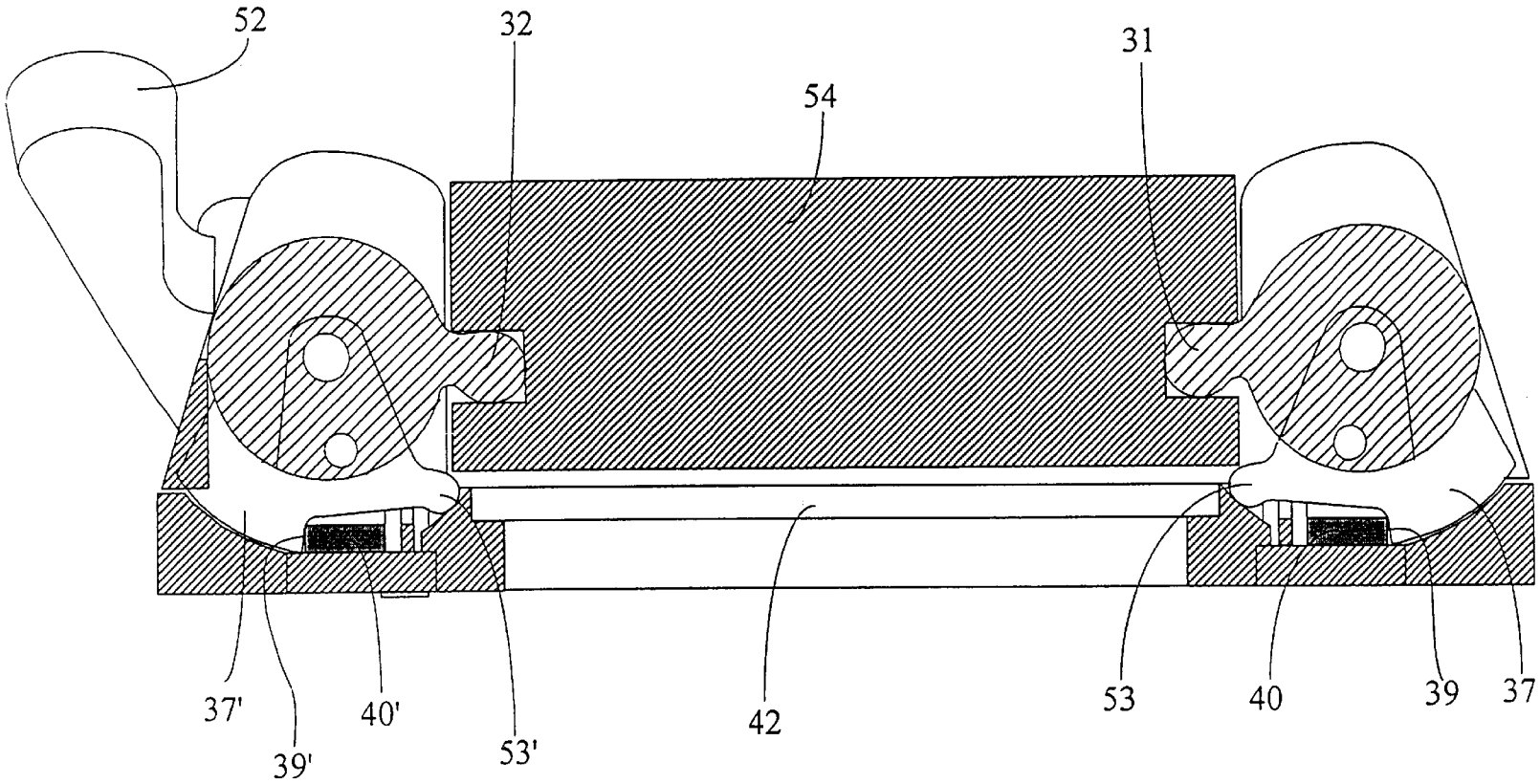
FIG. 21 is a view in section on XXI—XXI of FIG. 20.

If the boot can move down further, the jaws may continue their rotation in the closure direction. The fingers 40 and 40' can then continue to move forward, the ramps 46, 46' of these fingers sliding against the stops 39, 39' and therefore following the position of these stops, keeping the jaws locked. The lowermost position is depicted in FIGS. 20 and 21, the stops 39, 39' having reached the top of the ramps 46, 46'.

When the boot is in the binding, a pull-out force exerted on the boot tends to make the jaws rotate and the force of the cams 37 and 37' on the ramps 46 and 46' result in a component which tends to push the fingers 40 and 40' back. To avoid inadvertent jaw opening, additional friction has been introduced by means of an auxiliary bar 48, 48' associated with the finger 40, 40', and moving between two friction pads 49, 50 and 49', 50', respectively.

Boot release is achieved by actuating the release lever 52, which has the effect of withdrawing the fingers 40, 40' backward and therefore of releasing the jaws which rise under the effect of their return springs 59, 59'. The increase in the friction force opposing inadvertent binding opening could of course be achieved in a different way, by friction, hydraulically, by a piston or by a viscoelastic material.

Figures 22, 23:
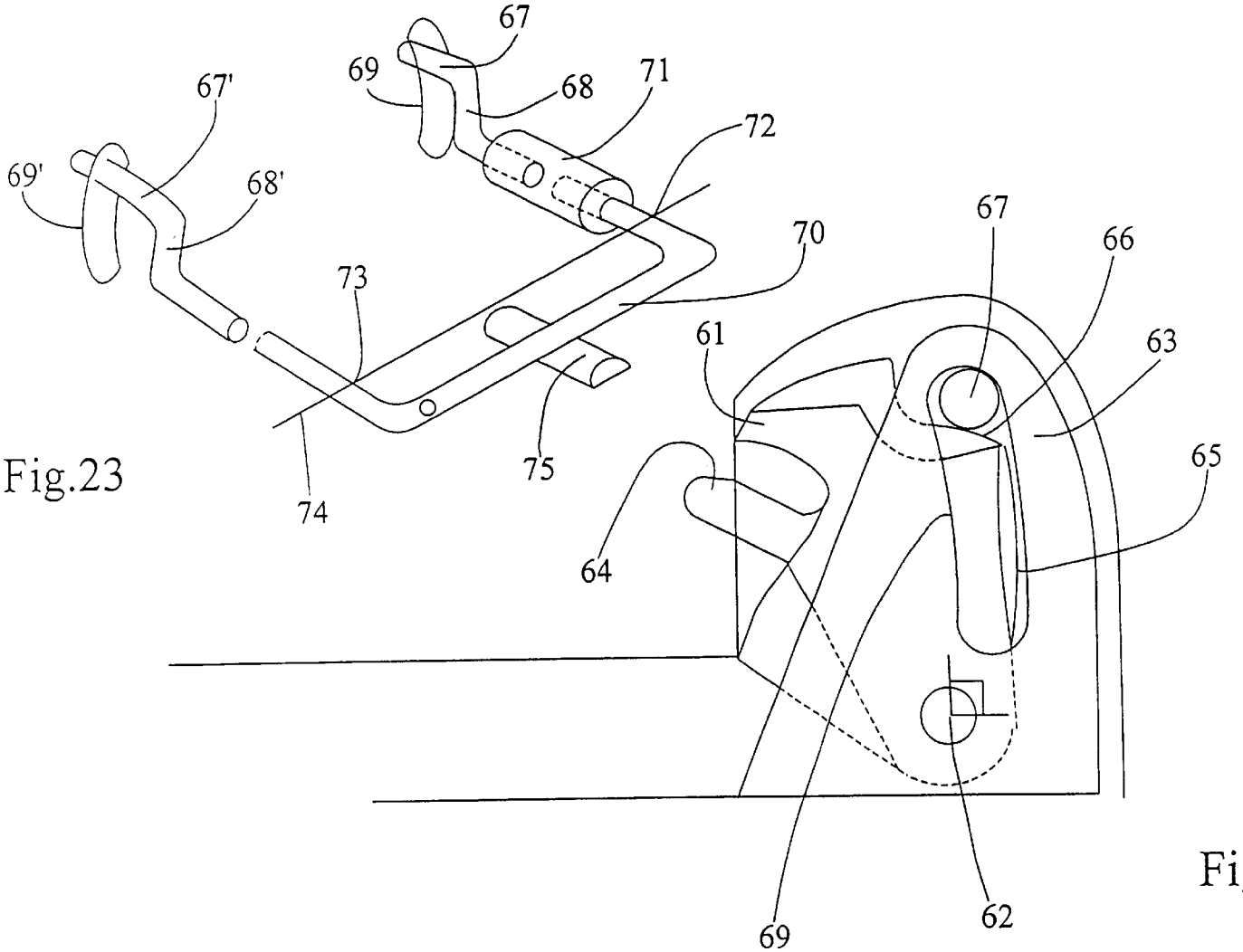
FIG. 22 diagrammatically depicts a simplified alternative form of the first embodiment.
FIG. 23 diagrammatically depicts the kinematic link between the pegs in this alternative form.
Figure 24:
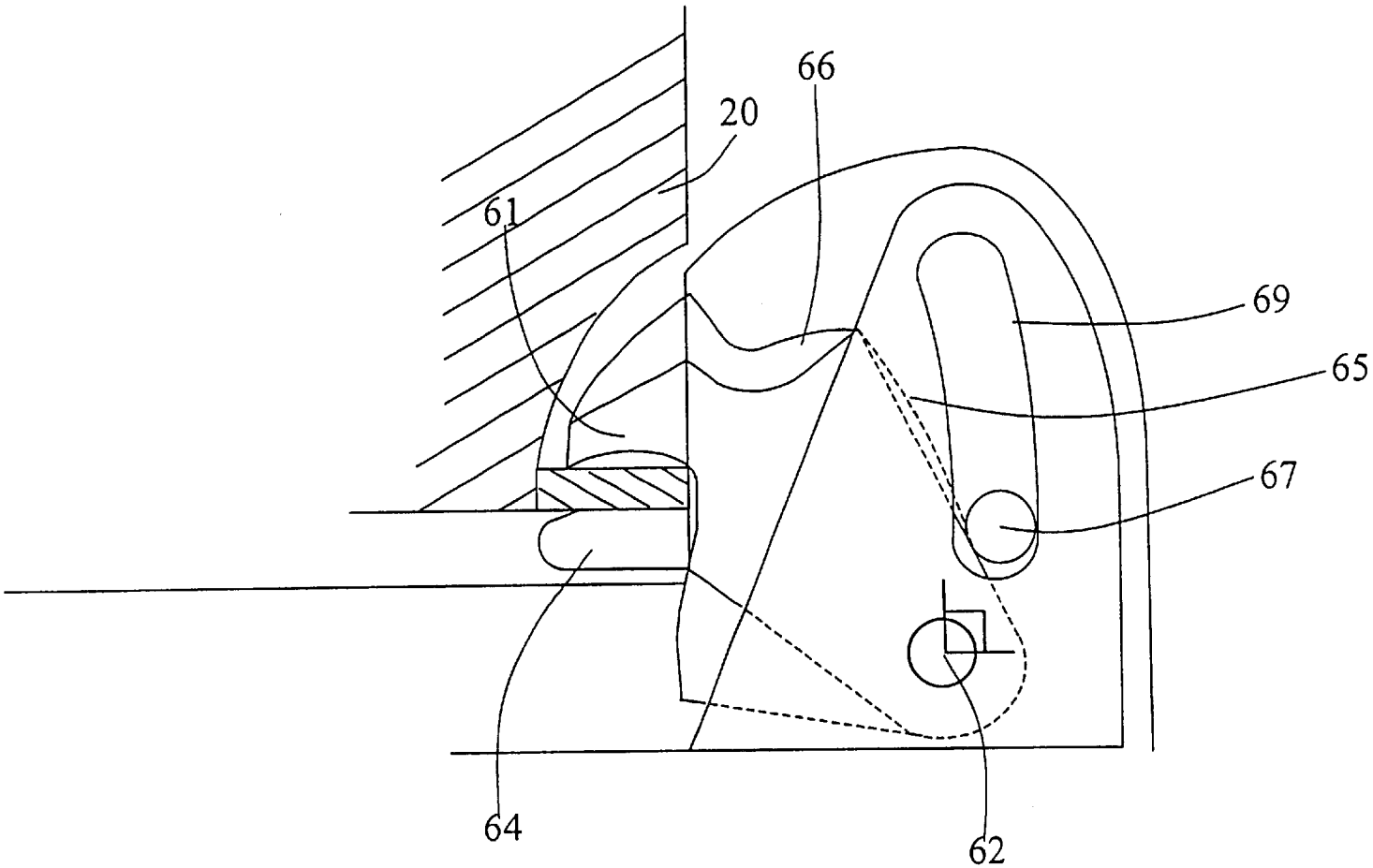
FIG. 24 depicts the alternative form in position on a boot.

A simplified alternative form of the first embodiment is depicted diagrammatically in FIGS. 22 to 24. The jaws are identical and the text will confine itself to describing one of the jaws.

The jaw 61, in the overall shape of a sector of a circle, is articulated about an axle 62 in a yoke 63. The axle 62 passes through the center of the circle corresponding to the sector of a circle. As in the first embodiment, the jaw 61 is urged elastically in its direction of opening by a spring surrounding the axle 62. The jaw 61 is equipped with an actuating pedal 64. On the other side of the pedal 64, the jaw has a domed cam-shaped part 65. Above the part 65, the jaw has a shoulder 66 which is slightly oblique when the jaw is in the raised position. The locking element here consists of the cylindrical horizontal arm 67 of a crank-shaped part 68 (FIG. 23). The locking element 67 passes right through the yoke 63 through two slots 69 similar to the slots 13 and 14 in the first embodiment. When the jaw is in the raised position depicted in FIG. 22, the locking element 67 is held by the shoulder 66 of the jaw at the top end of the slots 69. The crank-shaped part 68 and the corresponding part 68' on the other jaw are connected to the parallel arms of a rigid U-piece 70 constituting the kinematic link between the locking elements 67 and 67', by a linking piece 71 which exclusively allows the cranks 68 and 68' respectively to rotate. The linking piece is articulated at two opposed points 72 and 73 near the transverse part, so that the U-piece 70 with the cranks 68 and 68' tends to pivot about an axis 74 in a direction corresponding to the downward movement of the locking elements 67 and 67'.

When the boot is put into the binding, the boot 20 drives the jaw 61 via its pedal 64, as depicted in FIG. 24. During this downward movement, the locking element 67 leaves the shoulder 66 and moves down, guided by the slots 69, until it meets the cam 65 and locks the jaw. The coupling 71 allows the locking element 67 to follow the shape of the slots 69.

To release the boot from the binding, all that is required is for pressure to be exerted on the transverse part of the U-piece 70. The travel of the piece 70 is limited by a stop 75, so as to avoid twisting the cranks 68 and 68'.

As in the first embodiment, the slots 69 could be straight and vertical instead of being curved.

What is claimed:

1. A step-in snowboard binding designed to hold a boot by its sides, comprising a baseplate (1; 30) carrying at least one jaw (2; 31; 61) pivoting about a horizontal axis and secured to a driving arm (9; 53; 64) which is driven by the boot as the boot is introduced into the binding, and a retaining element (3; 32) opposite the jaw, in which binding the jaw has a cam-shaped part (9*a*; 37; 65) cooperating with a locking element (12; 40; 67) which moves in a corresponding guide along the cam-shaped part and is urged in a locking direction by an elastic means, the locking element cooperating with the corresponding guide such that the jaw is locked for various positions of the jaw corresponding to various boot levels relative to the baseplate, wherein the jaw (2; 31; 61) is equipped with a return spring (58; 59) which tends to keep the jaw in an open, unlocked position.

2. The binding as claimed in claim 1, wherein the opposite retaining element comprises a second jaw (3; 32) identical to the at least one jaw, these two jaws being kinematically linked (18; 42; 70) so that the two jaws can be lowered simultaneously.

3. The binding as claimed in claim 1, wherein the locking element (12; 67) is in the form of a peg and the guide (13, 14; 69) is directed at least approximately vertically.

4. The binding as claimed in claim 1, wherein said cam-shaped part (37) has a lateral face forming a stop for the locking element (40) and a cutout (38) forming a circumferential stop (39), and the locking element consists of a finger (40) which can move at least approximately parallel to the axis of rotation of the jaw and is in the shape of a wedge pressing against the circumferential stop (39) as it enters said cutout after the jaw has rotated a certain amount.

5. The binding as claimed in claim 2, wherein the kinematic link is between the locking elements (12, 12'; 40, 40'; 67, 67').

6. The binding as claimed in claim 2, wherein, in the closed, locked, position, the jaws have a differential play (19; 51), this play being eliminated when the binding is in the open position.

7. The binding as claimed in claim 3, wherein the jaws are kinematically linked by a bar (18) which at the same time constitutes a means for deliberately raising said sets of moving parts.

8. The binding as claimed in claim 3, wherein the jaw (61) has a bearing surface (66) holding the peg (67) at the top of the guide when the binding is in the open position.

9. The binding as claimed in claim 4, and which comprises means (48, 49, 50) intended to increase the friction forces that oppose inadvertent opening of the binding when it is closed around the boot.

10. The binding as claimed in claim 4, herein the opposite retaining element consists of a second jaw (32) identical to the first jaw and the two locking fingers (40, 40') are kinematically linked.

11. The binding as claimed in claim 5, wherein the kinematic link is by means of a bent bar (18; 42; 70).

12. The binding as claimed in claim 5, wherein, in the closed, locked, position, the jaws have a differential play (19; 51), this play being eliminated when the binding is in the open position.

13. The binding as claimed in claim 5, wherein the jaw (2) is mounted in a mount (7) forming a roughly vertical guide for said peg (12) and the jaw (2) comprises a means (6) for deliberately raising this set of moving parts, actuation of which allows the jaw to be raised and the radial arm (15) of the peg to be returned to a position resting against the mount.

14. The binding as claimed in claim 7, wherein said bar (18) is connected with play to the sets of moving parts (7, 7').

15. The binding as claimed in claim 8, wherein said peg (12) can rotate and is fitted with at least one radial arm (15) which rotates as one with the peg, pressing, via its end, against a stop (16) when the jaw is in the raised position, the jaw being secured to an auxiliary cam (10) retaining said radial arm in this position, the shape of this auxiliary cam being such that it releases the radial arm (15) when the jaw is lowered, allowing the locking peg to move into the locking position.

16. The binding as claimed in claim 8, wherein the peg (67) falls under gravity and is connected to an operating arm (70) for raising it.

17. The binding as claimed in claim 9, wherein the means for increasing the friction consist of an auxiliary bar (48) moving with friction between two friction pieces (49, 50).

18. The binding as claimed in claim 11, wherein, in the closed, locked, position, the jaws have a differential play (19; 51), this play being eliminated when the binding is in the open position.

19. The binding as claimed in claim 16, wherein the opposite retaining element consists of a second jaw identical to the first (61) and the pegs (67, 67') of the jaws are connected in terms of rotation to the operating arm (70) by a crank-shaped part (68, 68').

20. The binding as claimed in claim 16, wherein the opposite retaining element consists of a second jaw (32) identical to the first jaw and the two locking fingers (40, 40') are kinematically linked.

21. The binding as claimed in claim 19, wherein the opposite retaining element consists of a second jaw (32) identical to the first jaw and the two locking fingers (40, 40') are kinematically linked.

22. The binding as claimed in claim 20, wherein the kinematic link between the locking fingers consists of a bar (42) urged by elastic means which tend to push the bar toward the jaws.

23. The binding as claimed in claim 22, wherein one of the locking fingers is connected with play (51) to said bar so as to allow the boot to adopt a slightly oblique position relative to the binding when it is closed around the boot.

* * * * *